United States Patent [19]

Siegel et al.

[11] 4,091,363

[45] May 23, 1978

[54] SELF-CONTAINED FIRE DETECTOR WITH INTERCONNECTION CIRCUITRY

[75] Inventors: Steve L. Siegel, Lisle; Richard J. Schwarzbach, Naperville, both of Ill.

[73] Assignee: Pittway Corporation, Northbrook, Ill.

[21] Appl. No.: 756,493

[22] Filed: Jan. 3, 1977

[51] Int. Cl.[2] ..... G08B 17/10

[52] U.S. Cl. ..... 340/227 R; 340/228 R; 340/237 S

[58] Field of Search ..... 340/227 R, 228 R, 237 S, 340/237 R

[56] References Cited

U.S. PATENT DOCUMENTS

| | | | |
|---|---|---|---|
| Re. 28,915 | 7/1976 | Ogden et al. | 340/228 R |
| 3,676,877 | 7/1972 | Kobayashi | 340/227 R |
| 3,872,449 | 3/1975 | Scheidweiler | 340/227 R |

*Primary Examiner*—Glen R. Swann, III

*Attorney, Agent, or Firm*—Gary, Juettner & Pyle

[57] ABSTRACT

A fire detector for being connected in a system with a plurality of detectors, is characterized by interconnect circuitry for connecting with like circuitry of the other detectors. The interconnect circuitry causes all of the detectors to generate an alarm in response to any one of the detectors sensing combustion, and to generate an indication of an improper connection between the detectors.

13 Claims, 1 Drawing Figure

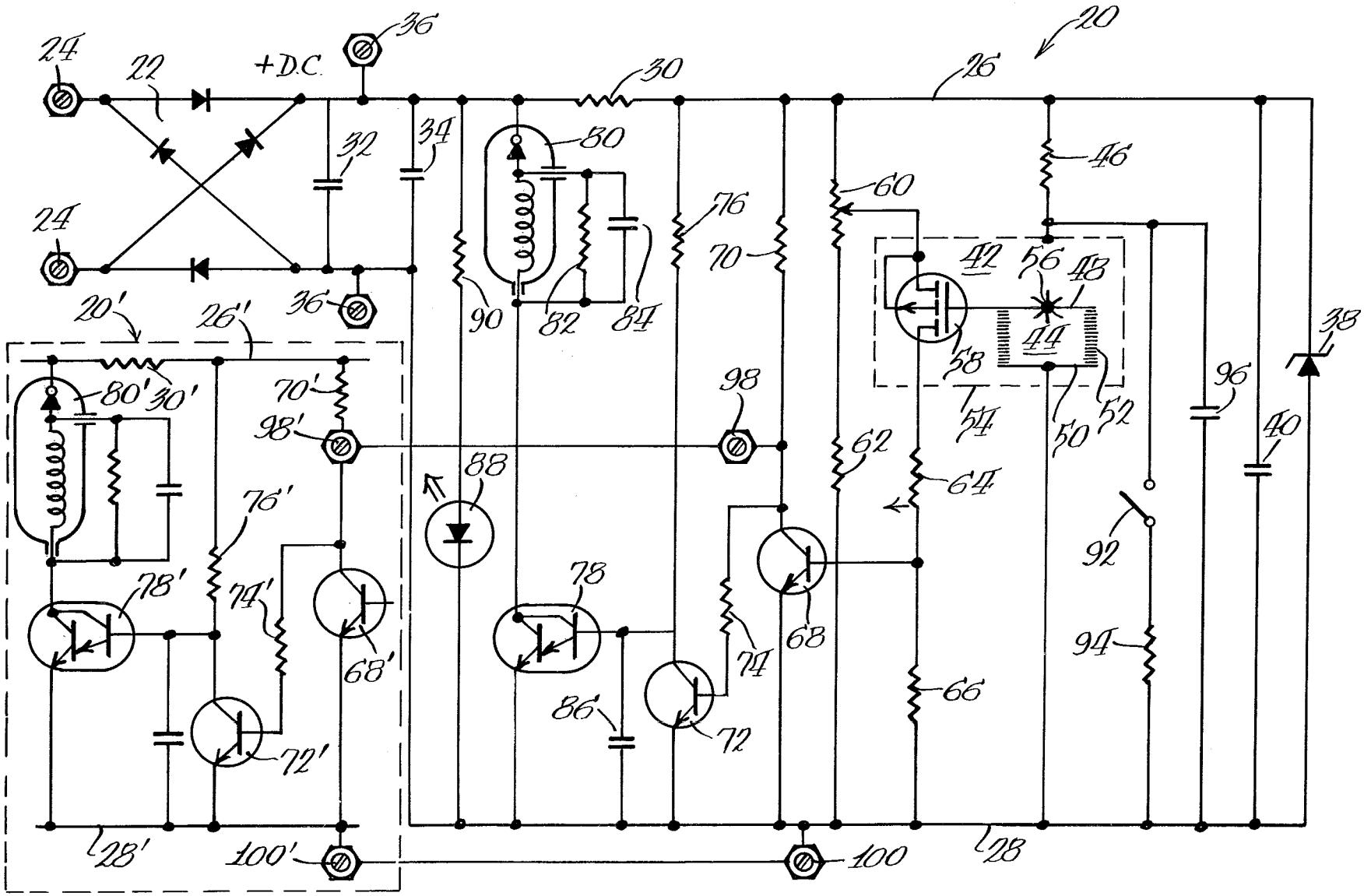
+D.C.

SELF-CONTAINED FIRE DETECTOR WITH INTERCONNECTION CIRCUITRY

BACKGROUND OF THE INVENTION

The present invention relates to fire detectors, and in particular to a fire detector for being connected in a system with a plurality of detectors.

Fire detection systems, of the type wherein a plurality of fire detectors are positioned at remote locations in a structure, commonly include a central control station for connecting with the detectors. In some such systems, the detectors are individually connected with the control station, whereby upon the occurrence of combustion a signal is provided at the station to indicate the location of the detector sensing combustion. In other systems, the detectors are connected in a loop circuit with the control station, and upon a detector sensing combustion a signal characteristic to that detector, such as a signal at a predetermined frequency, is provided over the loop to the station, whereby the location of the detector generating the signal may be determined by multiplexing techniques.

With these systems, it is possible to improperly interconnect the detectors and the control station, whereby the occurrence of combustion might not be detected. Further, the systems are complex, and not only have a relatively high initial cost, but also a continuing expense as a result of personnel required to monitor the control station. Accordingly, they are primarily advantageous for the early detection of combustion in large structures of sufficient economic value to justify the cost of the system, and where personnel are at all times available to monitor the control station. Unfortunately, for structures such as small office or apartment buildings having a number of individual units, the expense of such systems often cannot be justified.

OBJECTS OF THE INVENTION

An object of the present invention is to provide a fire detector, of inexpensive construction, for being connected in a system with a plurality of detectors, and having interconnect circuitry for connecting with like circuitry of the other detectors for causing all of the detectors to generate an alarm in response to any one of the detectors sensing combustion.

Another object of the present invention is to provide such a detector, the interconnect circuitry of which generates an indication of an improper connection between it and one or more detectors.

A further object of the present invention is to provide such a detector, which if disconnected from the other detectors nevertheless is responsive to the presence of products of combustion to generate an alarm.

SUMMARY OF THE INVENTION

In accordance with the present invention, a detecting device includes means for sensing the occurrence of predetermined phenomena, and means responsive to the sensing means for generating an indication of the occurrence of the phenomena. The generating means includes an interconnect circuit for being connected with a like interconnect circuit of at least one other detecting device. The interconnect circuits when connected are operative to cause the generating means to provide the indication either upon any one of the devices sensing the occurrence of the phenomena, or upon an improper connection between the interconnect circuits of the device.

The foregoing and other objects, advantages and features of the invention will become apparent from the following detailed description, when taken in conjunction with the appended drawing.

BRIEF DESCRIPTION OF THE DRAWINGS

The single drawing is a schematic illustration of a fire detector having interconnect circuitry in accordance with a preferred embodiment of the invention, showing the detector connected with a like interconnect circuit of another detector.

DETAILED DESCRIPTION

Referring to the drawing, there is shown a detector, indicated generally at 20, for sensing the occurrence of a predetermined phenomenom, such as the presence of products of combustion, and for generating an indication thereof. In accordance with the invention, the detector includes circuitry for connecting with like circuitry of one or more other detectors to form a fire detection system, the interconnect circuitry causing all of the detectors to generate the indication in response to any one of the detectors sensing products of combustion, and to also generate the indication upon an improper connection of the detectors.

More particularly, where the detector is to be a.c. powered, it may include a rectifier bridge 22 for receiving the a.c. voltage across a pair of input terminals 24, and for providing a d.c. voltage across a pair of conductor means 26 and 28, the conductor means 26 receiving the voltage through a resistor 30. Capacitors 32 and 34 filter and smooth the output voltage from the bridge. In the alternative, where the detector is to be battery powered or otherwise connected with an external source of d.c. voltage, a pair of input terminals 36 are provided at the output of the bridge for connecting with the source of d.c. voltage, the bridge in this case being unnecessary. In either event, means are provided, such as a zener diode 38 in parallel with a filter capacitor 40, for regulating the voltage between the conductor means 26 and 28 to a predetermined value.

The combustion sensing portion of the detector includes an ionization chamber assembly comprising an active ionization chamber 42 and a reference ionization chamber 44 in series with a resistor 46 between the conductive means 26 and 28. The reference chamber includes conductive electrodes 48 and 50 which are maintained in a spaced relationship by a spacer 52 of an insulating material, the electrodes and the spacer together forming a relatively imperforate closure. The active chamber includes a relatively perforate conductive housing 54 forming one electrode thereof in a spaced relationship with the electrode 48, the electrode 48 forming the other electrode of the chamber and being common to both the active and the reference chambers. Means are provided, such as a radioactive source 56 positioned within a passage through the electrode 48, for ionizing air molecules within both of the chambers, whereby with a voltage applied across the electrode 50 and the housing 54 an electric field is generated within each chamber to establish a current flow therethrough by movement of the ions between the electrodes. The active and the reference chambers thus form a bridge circuit, with a voltage at the electrode 48 being in accordance with the relative impedances of the chambers.

Changes in ambient conditions affect the ion current flow through the chambers, and therefore the impedances thereof. For naturally occurring slow changes in ambient conditions, such as changes in barometric pressure, temperature and relative humidity, the relatively closed reference chamber responds (changes its impedance) substantially simultaneously and equally with the active chamber, and the bridge remains balanced. The reference chamber thus compensates the bridge circuit for slow changes in ambient conditions. For relatively rapid changes in ambient conditions, as occur with combustion, products of combustion concentrate in the relatively open active chamber much more rapidly than in the reference chamber. The products of combustion have a greater mass than air molecules, and upon entry into the active chamber they combine with the ionized air molecules therein to effectively reduce the current flow. The reduced current flow increases the impedance of the chamber and, for the circuit connections shown, causes a decrease in the voltage at the common electrode 48. A predetermined decrease in the voltage at the electrode 48 may, then, be used as an indication of the occurrence of combustion.

Means for monitoring the voltage at the electrode 48 and for generating an indication upon a predetermined change in the value thereof include a field-effect transistor (FET) 58 connected at its gate with the electrode, and positioned within the active chamber housing 54 for being shielded against external static electricity and electric fields. A potentiometer 60 and a resistor 62 are connected in series between the conductor means 26 and 28, and the drain-source circuit path of the FET is connected in series with a pair of voltage divider resistors 64 and 66 between a slider for the potentiometer 60 and the conductor means 28. The potentiometer setting establishes a reference voltage for the FET, and for a given setting the conductivity of the FET, and therefore the current flow therethrough and the voltage at the juncture of the resistors 64 and 66, is determined by the voltage at the electrode 48, with a decrease in the value of the electrode voltage causing an increase in the conductivity of the FET, and therefore an increase in the voltage between the resistor 64 and 66.

A first transistor 68 is connected at its base to the juncture between the resistors 64 and 66, at its emitter to the conductor means 28, and at its collector to the conductor means 26 through a resistor 70. A second transistor 72 is connected at its base to the collector of the transistor 68 through a resistor 74, at its emitter to the conductor means 28, and at its collector to the conductor means 26 through a resistor 76. A Darlington transistor pair 78 is connected at its base to the collector of the transistor 72, at its emitter to the conductor means 28, and as its collector to the conductor means 26 through an alarm device shown as an audible horn 80. A resistor 82 and a capacitor 84 provide suppression for the horn, and a capacitor 86 between the base of the transistor 78 and the conductor means 28 inhibits false triggering of the transistor. An LED 88 is connected between the conductor means 26 and 28 through a resistor 90 to provide an indication that power is being applied to the detector. In the use of the detector, the transistors 68 and 72 form an interconnect circuit for being connected with a like interconnect circuit of at least one other detector, as will be described.

Under ambient conditions in the absence of products of combustion, the potentiometer 60 is adjusted to control the conductivity of the FET so that the voltage at the juncture between the resistors 64 and 66 is less than sufficient to render the transistor 68 conductive. With the transistor 68 nonconductive, the transistor 72 is biased into conduction through the resistors 70 and 74 to maintain the transistor 78 nonconductive, whereby the horn is not sounded.

Upon the occurrence of combustion, the relatively rapid increase in the impedance of the active chamber, with respect to that of the reference chamber, causes a decrease in the voltage at the electrode 48 to increase the conductivity of the FET sufficiently to render the transistor 68 conductive. Conduction of the transistor 68 turns off the transistor 72 by applying to the base thereof a voltage substantially equal to that on the conductor means 28, whereby the transistor 78 receives at its base through the resistor 76 the voltage on the conductor means 26. This turns on the transistor to energize the horn and sound an alarm, which continues until the active chamber is cleared of products of combustion.

To test the detector circuit 20 to ensure proper operation thereof, a manually operable switch 92 is connected in series with a resistor 94 between the active chamber housing 54 and the conductor means 28. Upon closure of the switch, the resistors 46 and 94 are connected as a voltage divider, and have values selected to decrease the voltage of the housing, and therefore the voltage across the chamber assembly, by at least an amount which causes a decrease in the voltage at the electrode 48 sufficient to render the transistor 68 conductive. Conduction of the transistor 68 then operates the remaining portion of the detector to generate an alarm, as above described. Thus, operation of the switch provides a change in the voltage at the electrode 48 as would occur upon combustion, and operates the entire circuit to sound an alarm. As compared with prior detectors having test switches which ordinarly operate only the audible alarm of the detector to test the sufficiency of the power supplied thereto, the switch 92 allows a user of the detector to conveniently, quickly and reliably test all components of the detector, a significant safety advantage. A capacitor 96 connected between the housing and the conductor means 28 smooths changes in voltage at the housing upon operation of the switch.

Particular advantages in the initial adjustment of the sensitivity of the detector are obtained of the values of the resistors 46 and 94 are selected to provide at the electrode 48, upon operation of the switch 92, a voltage exactly equal to that which would occur if products of combustion were in the active chamber in the minimum concentrations whereat it is desired to generate an alarm. With the resistors so selected, and with the switch closed, the potentiometer 60 is set to the point where the transistor 68 is just rendered conductive, whereupon the sensitivity of the detector circuit is properly adjusted.

The detector thus far described may, if desired, be used by itself for detecting products of combustion. In accordance with the invention, however, the detector advantageously is for being interconnected with a plurality of other detectors, as for example a plurality of detectors at remote locations in a structure, and to this end the invention provides in the particular arrangement of the transistors 68 and 72 an interconnect circuit. The interconnect circuit has a first interconnect terminal 98 connected with the collector of the transistor 68, and a second interconnect terminal 100 connected with the emitter thereof. To connect a plurality of the detectors, the first and the second interconnect terminals of each detector are connected with the first and the second interconnect terminals, respectively, of every other detector. This results in a fire detection system wherein alarm of any one detector in response to combustion causes all of the detectors to sound an alarm, and wherein an indication is generated of an improper connection between the detectors.

More particularly, and referring also to the portion of the drawing enclosed in dashed lines, which shows an interconnect and alarm circuit portion of another detector with like numbers with primes being used to indicate like components, the first interconnect terminal 98' thereof is connected with the terminal 98, and the second interconnect terminal 100' is connected with the terminal 100. Should one of the detectors, say the detector 20, sense the occurrence of combustion, the transistor 68 will become conductive to render the transistor 72 nonconductive and to energize the horn through the Darlington transistor pair 78. Rendering the transistor 68 conductive applies the voltage at the conductor means 28 to the first interconnect terminal 98 which, as a result of its connection with the terminal 98', applies the voltage to the base of the transistor 72' through the resistor 74'. This turns off the transistor 72' and causes the Darlington transistor pair 78' to energize the horn 80'. Similarly, should the detector 20' detect the occurrence of combustion, the horn 80 of the detector 20 will sound.

Should an improper connection be made between detectors, for example in hard wiring between detectors positioned at remote locations in a structure, the interconnect circuit provides for the generation of an alarm to indicate such connection. For example, should a connection to a first interconnect terminal actually be made to a second interconnect terminal, the voltage at the conductor means 28 will be connected with the base of the transistor 72 or 72', causing at least one of the detectors 20 or 20' to generate an alarm, Should a short circuit occur in the wiring between the detectors, the voltage at the conductive means 28 will be applied to all of the first interconnect terminals and the detectors will generate an alarm. If the connection between the detectors is broken, no alarm will be sounded, but any isolated detector will continue too function alone to detect combustion. While the drawing illustrates the connection of only two detector circuits, it is understood that the invention contemplates interconnecting as many detector circuits as desired in the manner shown, and that the description applies to any such number.

The invention thus provides a fire detector having an interconnect circuit enabling connection of the detector in a system with a plurality of other detectors having a like circuit. The interconnect circuit provides for all of the detectors to generate an alarm in response to any one detector sensing combustion, and for at least one of the detectors to sound an alarm in response to an improper connection between detectors. As a consequence of the test switch connecting across the ionization chamber assembly to change the voltage at the common electrode thereof, the entire detector circuit may conveniently be tested and the sensitivity of the detector may readily be adjusted.

While one particular embodiment of the invention has been described in detail, various modifications and other embodiments thereof may be devised by one skilled in the art without departing from the spirit and the scope of the invention, as defined by the claims.

What is claimed is:

1. In a detecting device, means for sensing the occurrence of predetermined phenomena, and means responsive to said sensing means for generating an indication of the occurrence of said phenomena, said means for generating including circuit means for being connected with like circuit means of at least one other detecting device, said circuit means when connected operating said means for generating to provide said indication either upon any one of the devices sensing the occurrence of said phenomena, or upon an improper connection between the circuit means of the devices.

2. In a detecting device as set forth in claim 1, said circuit means having first and second connection points for being connected with first and second connection points, respectively, of the like circuit means of the at least one other device, said circuit means operating said means for generating to provide said indication upon an improper connection between said connection points.

3. In a detecting device as set forth in claim 2, said circuit means being responsive to said sensing means sensing the occurrence of said phenomena to connect said first connection point with said second connection point thereof.

4. In a detecting device as set forth in claim 3, said circuit means including a first semiconductor device having a pair of controlled electrodes and a control electrode for controlling conduction between said controlled electrodes, one of said controlled electrodes connected with said first connection point and the other of said controlled electrodes connected with said second connection point, said control electrode connected with said sensing means for rendering said semiconductor device conductive between said controlled electrodes upon the occurrence of said phenomena.

5. In a detecting device as set forth in claim 4, said means for generating including indicator means, said circuit means including a second semiconductor device having a pair of controlled electrodes and a control electrode for controlling the conduction between said controlled electrodes, one of said controlled electrodes connected with said first connection point, the other of said controlled electrodes connected to said indicator means for controlling the operation thereof, said control electrode connected with said second connection point for controlling the conductivity between said controlled terminals to operate said indicator means when said second connection point is connected with said first connection point.

6. In a detecting device as set forth in claim 5, said first and second semiconductor devices being first and second transistors, said controlled electrodes being emitter and collector electrodes, said control electrodes being base electrodes.

7. In a detecting device as set forth in claim 6, said indicator means including audible alarm means in series circuit with a third transistor for being operated upon conduction thereof, said second transistor being conductive in the absence of a connection between said first and second connection points and nonconductive upon a connection being established between said points, said second transistor connected with its emittercollector in circuit between said first connection point and the base of said third transistor, and means for rendering said third transistor conductive to operate said audible alarm when said second transistor is nonconductive.

8. In a system of detecting devices, at least a pair of detecting devices, each having means for sensing the occurrence of predetermined phenomena, and means responsive to said sensing means for generating an indication of the occurrence of said phenomena, each said means for generating including circuit means, said circuit means of said detectors being interconnected and operating said responsive means of each said device to generate said indication either upon said sensing means of any one of said devices sensing said phenomena, or upon said circuit means of said devices being improperly connected in circuit.

9. In a system of detecting devices as set forth in claim 8, each said circuit means having first and second connection points, said first connection point of each said device being connected with said first connection point of every other said device, and said second connection point of each said device being connected with said second connection point of every other said device, said means for generating of at least one of said devices providing said indication upon an improper connection between said connection points.

10. In a system of detecting devices as set forth in claim 9, each said circuit means of each said device connecting said first connection point with said second connection point thereof upon said sensing means of that device sensing the occurrence of said phenomena.

11. In a system of detecting devices as set forth in claim 10, said detecting devices being fire detectors, said predetermined phenomena being products of combustion, said circuit means each including a first transistor connected with the emitter-collector circuit thereof between said first and said second connection points thereof, and connected at the base thereof with said sensing means for being rendered conductive thereby upon occurrence of combustion to connect said first connection point with said second connection point.

12. In a system of detecting devices as set forth in claim 11, each said means for generating including indicator means, each said circuit means including a second transistor connected with the emitter-collector circuit thereof between said indicator means and said first connection point, and connected at the base thereof with said second connection point for operating said indicator means when said second connection point is connected with said first connection point.

13. In a system of detecting devices as set forth in claim 12, each said indicator means including an audible alarm in series circuit with a third transistor for being operated upon conduction thereof, said second transistor of each said circuit means being conductive in the absence of a connection between said first and second connection points and nonconductive upon a connection being established between said points, said second transistor connected with its emittercollector in circuit between said first connection point and the base of said third transistor, and means for rendering said third transistor conductive to operate said audible alarm when said second transistor is nonconductive.

* * * * *